US006588731B2

(12) United States Patent
Nakamura et al.

(10) Patent No.: US 6,588,731 B2
(45) Date of Patent: Jul. 8, 2003

(54) HOISTING AND TOWING DEVICE

(75) Inventors: Takayoshi Nakamura, Yamanashi (JP); Akira Osano, Yamanashi (JP)

(73) Assignee: Kito Corporation, Yamanashi (JP)

( * ) Notice: Subject to any disclaimer, the term of this patent is extended or adjusted under 35 U.S.C. 154(b) by 0 days.

(21) Appl. No.: 09/979,638

(22) PCT Filed: Mar. 23, 2001

(86) PCT No.: PCT/JP01/02361

§ 371 (c)(1),
(2), (4) Date: Feb. 20, 2002

(87) PCT Pub. No.: WO01/72626

PCT Pub. Date: Oct. 4, 2001

(65) Prior Publication Data

US 2003/0098452 A1 May 29, 2003

(30) Foreign Application Priority Data

Mar. 27, 2000 (JP) ..... 2000-086445

(51) Int. Cl.[7] ..... B66D 1/14
(52) U.S. Cl. ..... 254/352; 254/342; 254/344
(58) Field of Search ..... 254/352, 372, 254/342, 344

(56) References Cited

U.S. PATENT DOCUMENTS

| | | | | |
|---|---|---|---|---|
| 5,238,226 A | | 8/1993 | Nishimura | |
| 6,059,267 A | * | 5/2000 | Nishimura | 254/352 |
| 6,406,001 B1 | * | 6/2002 | Wada | 254/352 |

* cited by examiner

*Primary Examiner*—Kathy Matecki
*Assistant Examiner*—Evan H Langdon
(74) *Attorney, Agent, or Firm*—Wenderoth, Lind & Ponack, L.L.P.

(57) ABSTRACT

In a hoisting/pulling device comprising a pinion gear 4, reduction gears 5*a* which are meshed with the pinion gear 4 and are rotatably mounted in a frame 1, and a load sheave which is interlocked with reduction gears 5*b* and is rotatably mounted in a frame 1, reduction gear bearings 8 are contiguously formed with a load sheave bearing 7 which is formed in the center of the frame 1. By making the distance between the axes of the reduction gears small and by forming the load gear and the load sheave integrally, it becomes possible to provide the hoisting/pulling device which can make the whole device compact and lightweight and can reduce the number of parts and man hours for machining the device.

35 Claims, 6 Drawing Sheets

HOISTING AND TOWING DEVICE

TECHNICAL FIELD

The present invention relates to a hoisting/pulling device, and more particularly to a hoisting/pulling device which can make the whole device compact and lightweight and can reduce the number of parts and the man-hours for machining and assembling the device.

BACKGROUND ART

The support structure of reduction gears and the structure of a load gear in a conventional hoisting/pulling device are explained in conjunction with FIG. 5 and FIG. 6.

In these drawings, numeral 21 indicates a frame for a load sheave bearing and reduction gear bearings, numeral 22 indicates a load sheave, numeral 23 indicates a load gear, numeral 24 indicates a pinion gear, numeral 25 indicates reduction gears which are meshed with the pinion gear 24, numeral 26 indicates reduction gears which are mounted coaxially with the reduction gears 25, numeral 27 indicates the load sheave bearing which is formed in the center of the frame 21, numeral 28 indicates bearings for reduction gear shafts which are disposed at positions outside the load sheave bearing 27 and at a given distance away from the load sheave bearing 27, numeral 29 indicates an upper hook mounting hole, numeral 30 indicates holes for mounting stud bolts, numeral 31 indicates stud bolts, numeral 32 indicates an upper hook, numeral 34 indicates a mechanical brake which is comprised of brake plates, a brake support, a ratchet wheel and a pawl, numeral 35 indicates a pinion shaft, numeral 36 indicates a manipulation lever, and numeral 37 indicates a casing.

In the above-mentioned conventional device, as shown in FIG. 6, the bearings 28 for the reduction gear which are formed in the frame 21 are, to ensure the support strength of the frame, disposed at a position of a given distance A away from the load sheave bearing 27. Accordingly, the distance between the axes of the pinion gear and each reduction gear and the distance between the axes of each reduction gear and the load gear respectively become large and the diameters of the respective gears become large. Eventually, the casing which covers these gears becomes large. Further, since the distance between the axes of the reduction gears 25 and 26 is large, it is necessary to insert the load gear 23 between the reduction gear 26 and the load sheave 22 to transmit the rotation of the reduction gear 26 to the load sheave. Further, since the load gear has a diameter which is larger than that of a bearing portion of the load sheave, it is necessary to assemble the pinion shaft having the load gear and the pinion gear after assembling the load sheave into the bearing portion of the frame.

DISCLOSURE OF THE INVENTION

As described above, in the conventional hoisting/pulling device, the distance between the axes of the reduction gear and the pinion gear and the distance between the axes of the reduction gear and the load gear are large and the respective gears are large in size. This prevents the hoisting/pulling device from being miniaturized. Further, it is necessary to assemble the pinion shaft having the load gear and the pinion gear after assembling the load sheave into the bearing of the frame, and hence, it is difficult to integrally form the load gear and the load sheave preliminarily. The present invention has been made to solve these drawbacks of the conventional device and provides a hoisting/pulling device which can make the whole device compact and lightweight and can reduce the number of parts and the man-hours for machining and assembling the device by making the distance between the axes of the reduction gears small and by making the outer diameter of the load gear equal to or smaller than the diameter of the bearing portion of the load sheave, and by integrally forming the load gear on the load sheave preliminarily.

Figure 1:
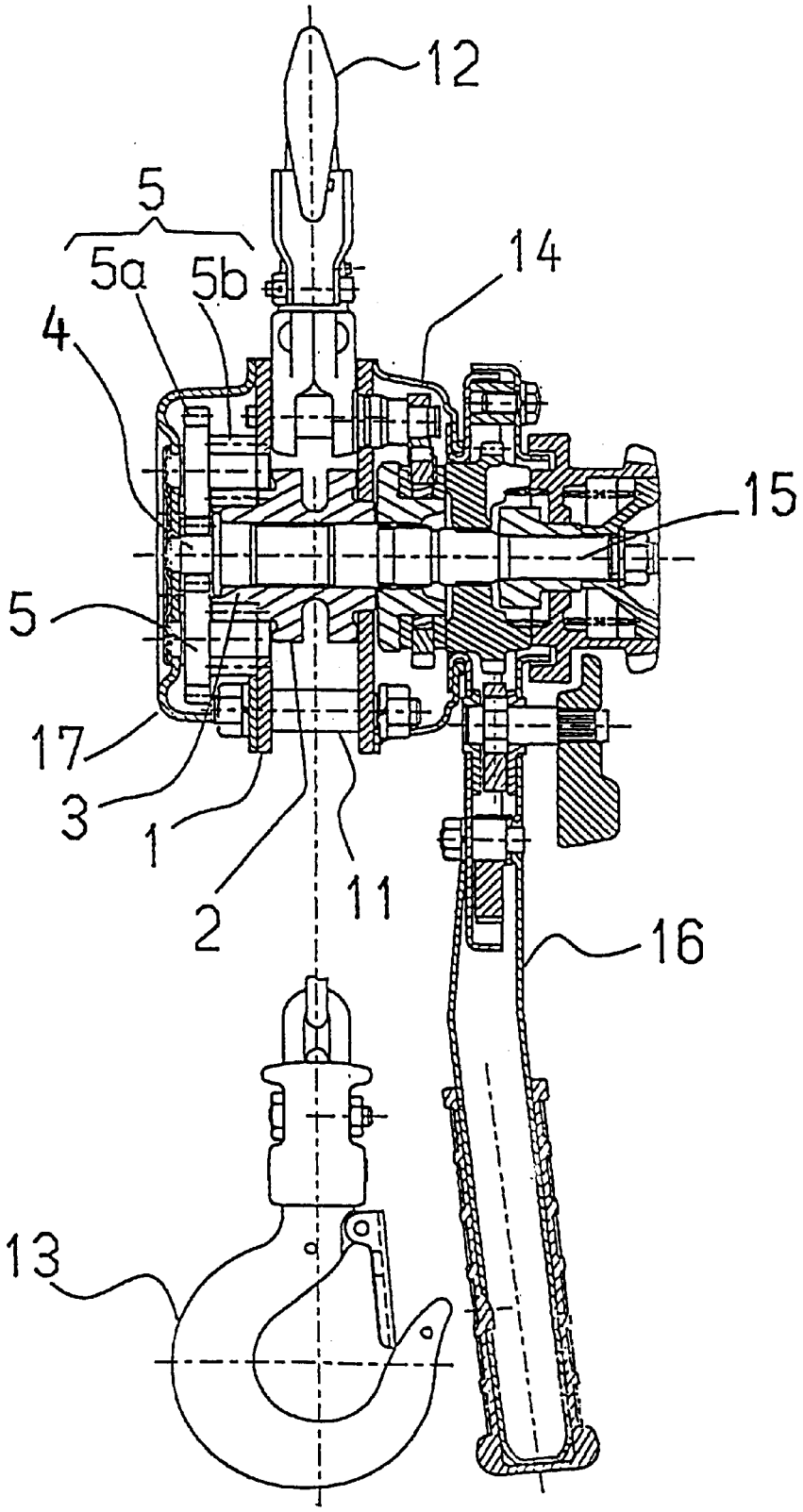
FIG. 1 is a longitudinal cross-sectional view of a hoisting/pulling device of the present invention.

Numerals in the drawings indicate followings.

1 frame
1*a* frame for load sheave bearing
1*b* frame for reduction gear bearing
2 load sheave
3 load gear
4 pinion gear
5*a* reduction gear
5*b* reduction gear
7 load sheave bearing
7*a* load sheave bearing
8 reduction gear bearing
8*a* reduction gear bearing
9 upper hook mounting hole
10 stud bolt mounting hole
11 stud bolt
12 upper hook
13 lower hook
14 mechanical brake
15 pinion shaft
16 manipulation lever
17 casing

BEST MODE FOR CARRYING OUT THE INVENTION

The present invention has been made in view of the drawbacks that the above-mentioned conventional technique has and is directed to a hoisting/pulling device which includes a pinion gear, reduction gears which are interlocked with the pinion gear, and a load sheave which is driven by way of a load gear which is interlocked with the reduction gears, wherein the load gear has a diameter equal to or smaller than an outer diameter of a bearing portion of the load sheave and the reduction gears are directly meshed with the load gear.

According to the present invention, by making the diameter of the load gear equal to or smaller than the outer diameter of the load sheave, the distance between the axes of the load gear and the reduction gears which are meshed with the load gear can be made small so that the reduction gears can be rotatably mounted in the bearings which are contiguously formed with the load sheave bearing. Accordingly, an advantageous effect is thereby achieved because the device can be made compact and lightweight and the number of parts as well as the man-hours for machining and assembling the device can be reduced.

According to an aspect of the present invention, a hoisting/pulling device includes a pinion gear, reduction gears which are interlocked with the pinion gear, and a load sheave which is driven by way of a load gear which is interlocked with the reduction gear, wherein the load gear has a diameter equal to or smaller than an outer diameter of a bearing portion of a load sheave and the reduction gears are directly meshed with the load gear. By making the load gear have a diameter equal to or smaller than the outer diameter of the bearing portion of the load sheave, it becomes possible to integrally form the load sheave and the load gear so that the load sheave can be assembled into the frame in the state that occurs when the load sheave is integrally assembled with the load gear. Accordingly, the number of parts and the man-hours for machining and assembling the device can be reduced thus giving rise to an advantageous effect that a low-cost hoisting/pulling device can be provided.

According to another aspect of the present invention, the device is characterized by forming the load sheave and the load gear by an integral molding. This provision reduces the number of parts and the man-hours for machining and assembling the device.

According to another aspect of the present invention, the device is characterized by rotatably mounting the reduction gear in the reduction gear bearings which are contiguously formed with a load sheave bearing which is formed in the center of the frame. Due to such a construction, the distance between the axes of the load gear and the reduction gears which are meshed with the load gear can be made small, and hence, the respective gears can be made compact. Accordingly, the device can be advantageously made compact and lightweight and the number of parts and the man-hours for machining and assembling the device can be reduced.

According to another aspect of the present invention, the device is characterized such that a frame for rotatably supporting the load sheave and the reduction gear is comprised of a first frame and a second frame which are arranged close to each other, wherein the load sheave is rotatably mounted in a bearing of the first frame and the reduction gears are rotatably mounted in the second frame which is provided with reduction gear bearings that are contiguously formed with the load sheave bearing. Since the load sheave bearing and the reduction gear bearing can be machined separately, an advantageous effect that the machining of these parts can be facilitated is obtained.

Embodiments of the present invention are explained hereinafter in conjunction with drawings.

EMBODIMENT 1

Figure 2:
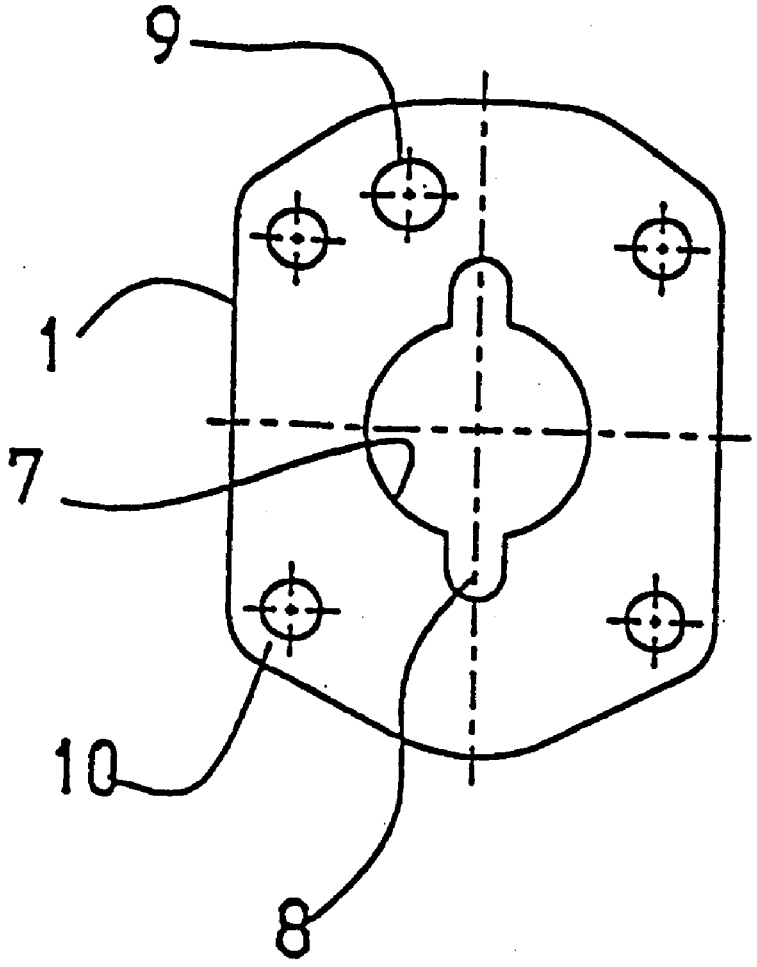
FIG. 2 is a plan view of a frame shown in FIG. 1.

The supporting structure of reduction gears and the structure of a load gear in a hoisting/pulling device of the present invention are explained in conjunction with FIG. 1 and FIG. 2.

In the drawings, numeral 1 indicates a frame which is provided with a load sheave bearing and a reduction gear bearing, numeral 2 indicates a load sheave which is rotatably mounted between the frame 1 and a frame which faces the frame 1 in an opposed manner, numeral 3 indicates a load gear which has a diameter equal to or smaller than an outer diameter of a bearing portion of the load sheave 2 and is integrally formed with the load sheave, numeral 4 indicates a pinion gear, numeral 5*a* indicates reduction gears a which are meshed with the pinion gear 4, and numeral 5*b* indicates reduction gears b which are rotatably mounted coaxially with the reduction gears 5*a*. The reduction gears 5*a* and the reduction gears 5*b* form a pair of reduction gears 5 and these gears are respectively meshed with the pinion gear and the load gear. With the provision of a plurality of reduction gears, the transmission torque can be dispersed and the reaction forces in the radial direction between gears which are meshed with each other can be cancelled so that respective gears can be miniaturized and respective bearings can be miniaturized. Numeral 7 indicates the bearing for the load sheave which is formed in the center of the frame 1, numeral 8 indicates bearings for shafts of the reduction gears 5 which are contiguously formed at the outside of the load sheave bearing 7, numeral 9 indicates an upper hook mounting hole, numeral 10 indicates stud bolt mounting holes, numeral 11 indicates stud bolts, numeral 12 indicates an upper hook, numeral 13 indicates a chain which is provided with a lower hook at one end thereof, numeral 14 indicates a mechanical brake which is comprised of brake plates, a brake support, a ratchet wheel and a pawl, and numeral 15 indicates a pinion shaft which passes through a through hole formed in the center of the load sheave, is rotatably mounted and is provided with the pinion gear at one end thereof and the mechanical brake 15 at the other end thereof. Numeral 16 indicates a manipulation lever, and numeral 17 indicates a casing. Bearings for shafts of the pinion gear 4 and the reduction gear 5 are mounted on the casing 17.

The manner of operation of the device is explained. When the manipulation lever 16 is rotated, the rotational force is transmitted to the pinion shaft 15 by way of the mechanical brake 14. Then, the load sheave 2 is rotated by way of the pinion gear 4 which is formed on one end of the pinion shaft 15, a pair of reduction gears 5 and the load gear 3. Accordingly, a chain which is wrapped around the load sheave 2 is wound around so as to hoist or draw a load using the lower hook provided to one end of the chain.

In the present invention, as shown in FIG. 1 and FIG. 2, by making a diameter of the load gear 3 equal to or smaller than an outer diameter of the bearing portion of the load sheave 2, the load gear 3 can be integrally formed with the load sheave 2 preliminarily. Further, the reduction gear 5 can be rotatably mounted in the bearings 8 for the shafts of the reduction gear 5 which are contiguously formed with the load sheave bearing 7 formed in the frame 1. Accordingly, it is unnecessary to provide a distance for ensuring the wall thickness between the bearings as in the case of the conventional device, and thus the distance between the bearings can be shortened and respective gears can be miniaturized, whereby the hoisting/pulling device can be miniaturized and made lightweight. Further, the load gear can be preliminarily assembled into the load sheave or the load gear and the load sheave can be formed by an integral molding. Further, the pinion shaft having the pinion gear is also preliminarily assembled into the load sheave. Accordingly, at the time of assembling the load sheave into the frame, it is possible to assemble a plurality of these parts as a unit so that the number of parts and the man-hours for machining and assembling the device can be reduced and thus the manufacturing cost can be reduced.

EMBODIMENT 2

Figure 3:
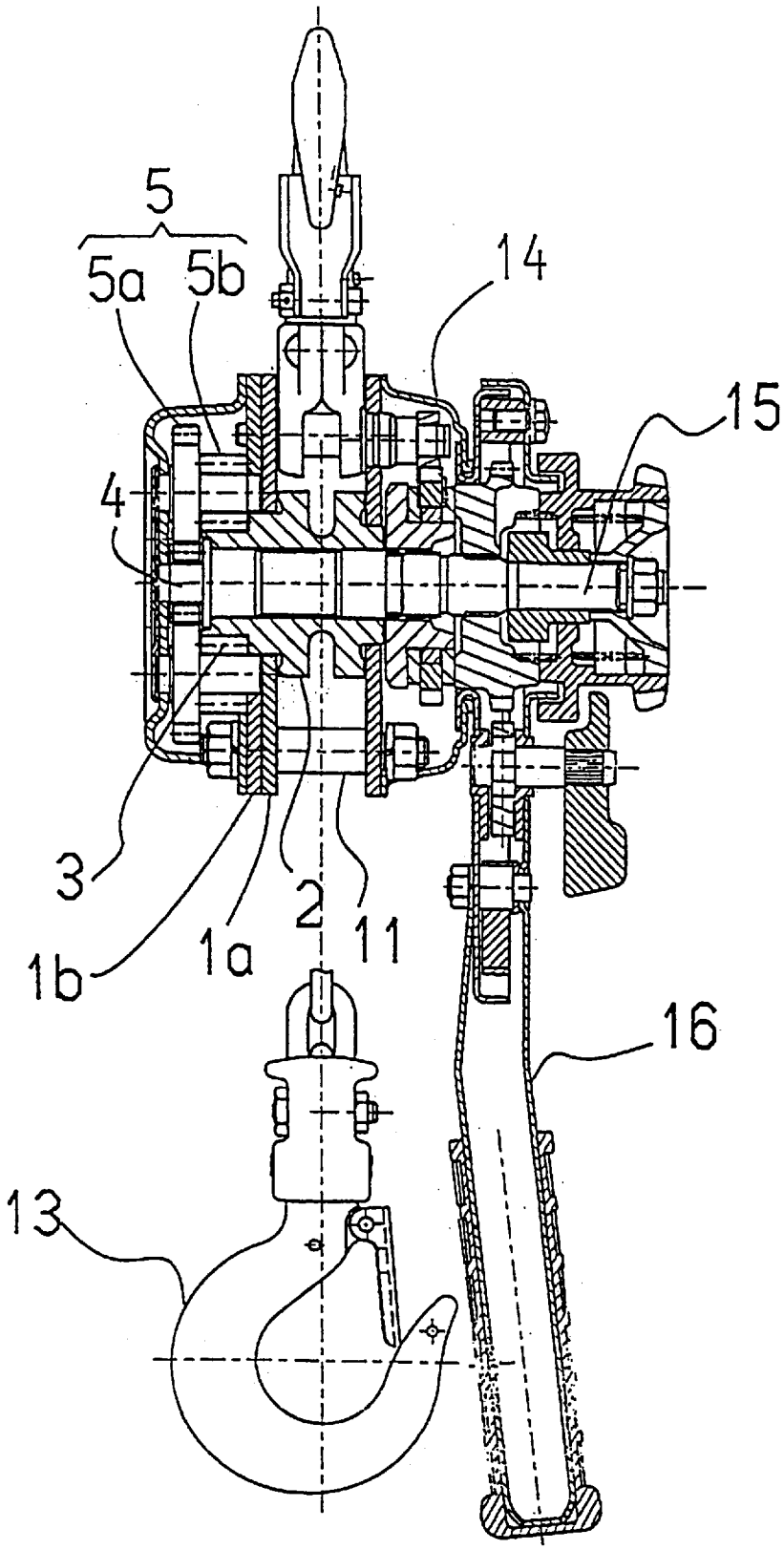
FIG. 3 is a longitudinal cross-sectional view of a hoisting/pulling device of another embodiment of the present invention.
Figure 4:
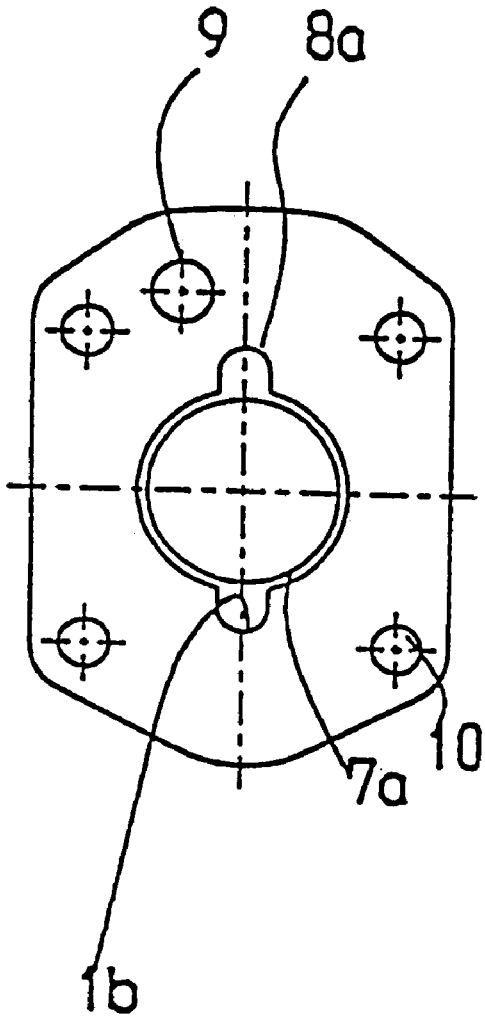
FIG. 4 is a plan view of a frame shown in FIG. 3.
Figure 5:
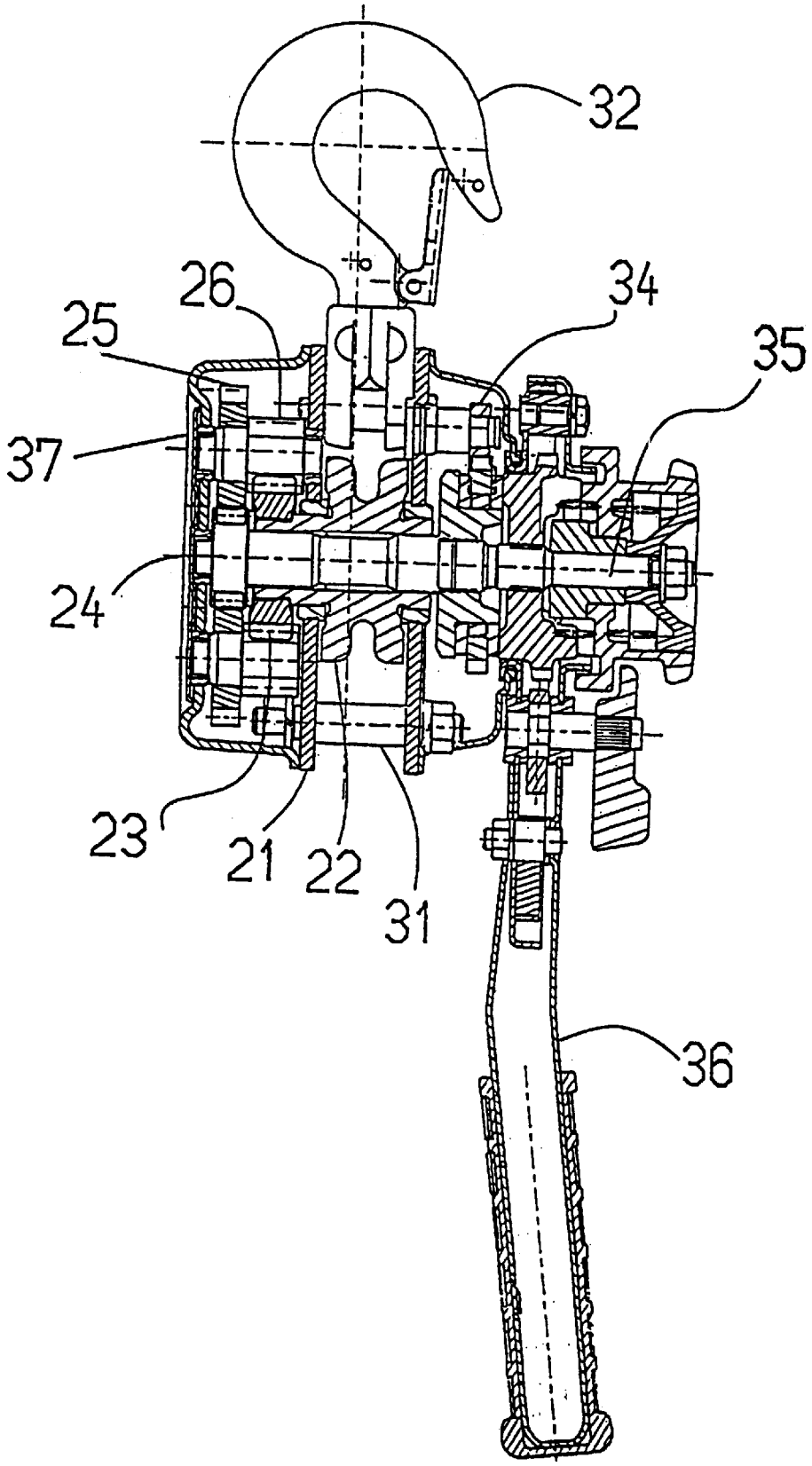
Fig. 5 (Prior Art)
FIG. 5 is a longitudinal cross-sectional view of a conventional hoisting/pulling device.
Figure 6:
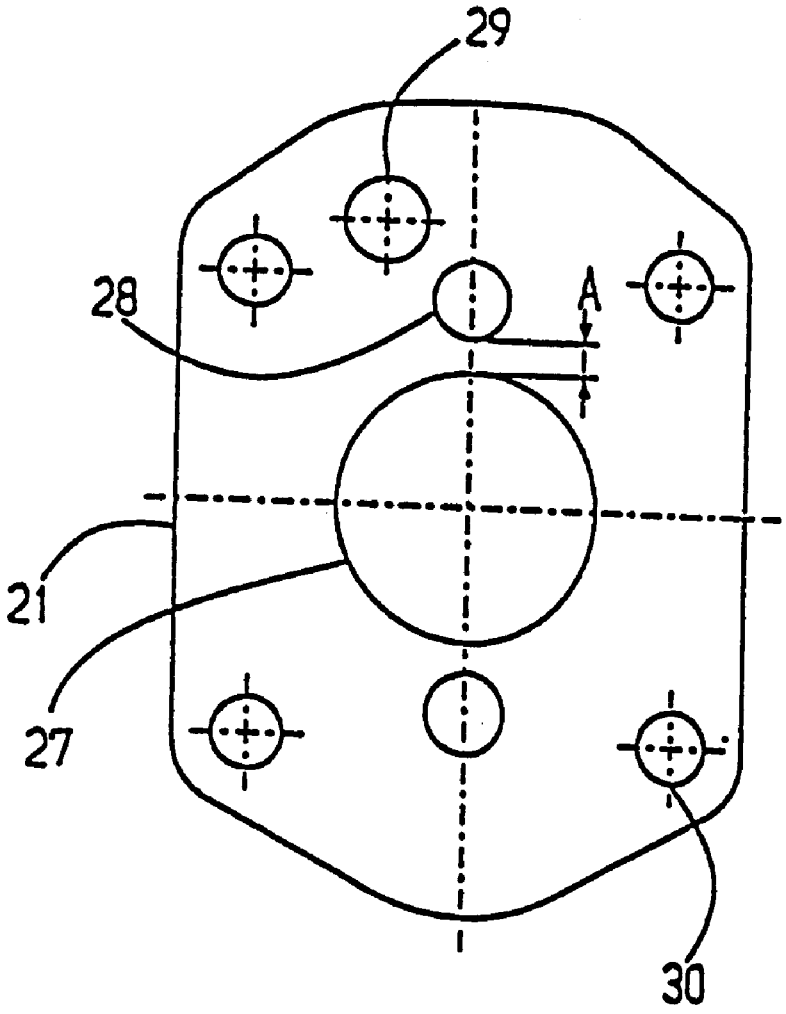
Fig. 6 (Prior Art)
FIG. 6 is a plan view of a conventional frame.

An embodiment 2 of the present invention is explained in conjunction with FIG. 3 and FIG. 4.

According to this embodiment, in a hoisting/pulling device provided with a transmission mechanism equal to that of the embodiment 1, the frame is formed of a first frame 1 a and a second frame 1*b* which are arranged close to each other. A bearing 7*a* which rotatably supports the load sheave 2 is provided to the first frame 1*a*, while bearings 8 for shafts of reduction gears 5 are formed in the second frame 1*b* contiguously with a through hole which allows a bearing portion of the load sheave and the load gear to pass therethrough. Further, the load sheave 2 is rotatably mounted in the first frame, while the reduction gears 5 are rotatably mounted in the second frame 1*b*. Due to such a construction, this embodiment performs the operation equal to that of the embodiment 1. Further, since the load sheave bearing and the reduction gear shaft bearing can be separately machined, the machining of these bearings can advantageously be facilitated compared to a case in which the contiguous bearings are integrally formed.

INDUSTRIAL APPLICABILITY

According to the present invention, the diameter of the load gear is made equal to or smaller than the outer diameter of the load sheave and the reduction gears are rotatably mounted in the bearings which are contiguously formed with the load sheave bearing. Therefore, it is unnecessary to provide the distance between the load sheave bearing and the reduction gear shaft bearing as in the case of the conventional device and thus the distance between the axes of the reduction gear and the axis of the load gear and the pinion gear can be made small. Accordingly, respective gears can be miniaturized. Further, since the load gear and the load sheave are formed by an integral molding, the pinion shaft which is provided with the load sheave and the pinion gear can be preliminarily assembled as a unit so that the device can be miniaturized and made lightweight and the number of parts or the man-hours for machining and assembling can be reduced so that the hoisting/pulling device can be provided at a low cost.

What is claimed is:

1. A hoisting/pulling device comprising:

a load sheave having a bearing portion and a shaft insertion hole;

a frame member bearing said load sheave at said bearing portion thereof;

a pinion shaft received through said shaft insertion hole of said load sheave such that said load sheave is rotatably mounted on said pinion shaft;

a pinion gear provided on said pinion shaft and fixed for rotation therewith;

reduction gears interlocked with said pinion gear; and a load gear interlocked with said reduction gears;

wherein said load gear has a diameter equal to or smaller than an outer diameter of said bearing portion of said load sheave, whereby said load sheave, said load gear and said pinion gear can be inserted as a unit into said load sheave bearing.

2. A hoisting/pulling device according to claim 1, wherein said load gear is provided on said load sheave for rotation therewith.

3. A hoisting/pulling device according to claim 1, wherein said load gear, said load sheave, said pinion gear, and said pinion shaft are rotatable about a common axis.

4. A hoisting/pulling device according to claim 1, wherein said load gear is fixed to said load sheave.

5. A hoisting/pulling device according to claim 1, wherein said load gear is integrally formed with said load sheave.

6. A hoisting/pulling device according to claim 1, wherein said load gear is disposed axially between said pinion gear and said bearing portion of said load sheave.

7. A hoisting/pulling device according to claim 1, further comprising reduction gear bearings, wherein said reduction gears are rotatably mounted in said reduction gear bearings, and said reduction gear bearings are contiguously formed with said bearing portion of said load sheave.

8. A hoisting/pulling device according to claim 1, wherein said bearing portion of said load sheave is provided at a center of said frame member.

9. A hoisting/pulling device according to claim 1, wherein said frame member rotatably supports said load sheave and said reduction gears.

10. A hoisting/pulling device according to claim 1, wherein said frame member comprises a first frame and a second frame arranged adjacent to each other.

11. A hoisting/pulling device according to claim 10, wherein a bearing is provided in said first frame, said load sheave is rotatably mounted in said bearing provided in said first frame, and said reduction gears are rotatably mounted in said second frame.

12. A hoisting/pulling device comprising a pinion gear, reduction gears which are interlocked with said pinion gear, and a load sheave which is driven by way of a load gear which is interlocked with said reduction gears, wherein said load gear has a diameter equal to or smaller than an outer diameter of a bearing portion of said load sheave, said reduction gears are directly meshed with said load gear, and said load sheave and said load gear are integrally formed.

13. A hoisting/pulling device according to claim 12, wherein said load sheave further comprises a shaft insertion hole.

14. A hoisting/pulling device according to claim 13, further comprising a pinion shaft received through said shaft insertion hole.

15. A hoisting/pulling device according to claim 14, wherein said pinion gear is provided on said pinion shaft and fixed for rotation therewith.

16. A hoisting/pulling device according to claim 14, wherein said load sheave is rotatably mounted on said pinion shaft.

17. A hoisting/pulling device according to claim 14, wherein said load gear, said load sheave, said pinion gear, and said pinion shaft are rotatable about a common axis.

18. A hoisting/pulling device according to claim 12, wherein said load gear is disposed axially between said pinion gear and said bearing portion of said load sheave.

19. A hoisting/pulling device according to claim 12, further comprising reduction gear bearings, wherein said reduction gears are rotatably mounted in said reduction gear bearings, and said reduction gear bearings are contiguously formed with said bearing portion of said load sheave.

20. A hoisting/pulling device according to claim 12, further comprising a frame member, wherein said frame member bears said load sheave at said bearing portion thereof.

21. A hoisting/pulling device according to claim 20, wherein said bearing portion of said load sheave is provided at a center of said frame member.

22. A hoisting/pulling device according to claim 20, wherein said frame member rotatably supports said load sheave and said reduction gears.

23. A hoisting/pulling device according to claim 20, wherein said frame member comprises a first frame and a second frame arranged adjacent to each other.

24. A hoisting/pulling device according to claim 23, wherein a bearing is provided in said first frame, said load sheave is rotatably mounted in said bearing provided in said first frame, and said reduction gears are rotatably mounted in said second frame.

25. A hoisting/pulling device comprising:

a load sheave having a bearing portion and a shaft insertion hole;

a pinion shaft received through said shaft insertion hole;

a pinion gear provided on said pinion shaft;

reduction gears interlocked with said pinion gear; and a load gear interlocked with said reduction gears, said load gear being integrally formed with said load sheave for driving said load sheave;

wherein said load gear has a diameter equal to or smaller than an outer diameter of said bearing portion of said load sheave.

26. A hoisting/pulling device according to claim 25, wherein said pinion gear is fixed for rotation with said pinion shaft.

27. A hoisting/pulling device according to claim 25, wherein said load sheave is rotatably mounted on said pinion shaft.

28. A hoisting/pulling device according to claim 25, wherein said load gear, said load sheave, said pinion gear, and said pinion shaft are rotatable about a common axis.

29. A hoisting/pulling device according to claim 25, wherein said load gear is disposed axially between said pinion gear and said bearing portion of said load sheave.

30. A hoisting/pulling device according to claim 25, further comprising reduction gear bearings, wherein said reduction gears are rotatably mounted in said reduction gear bearings, and said reduction gear bearings are contiguously formed with said bearing portion of said load sheave.

31. A hoisting/pulling device according to claim 25, further comprising a frame member, wherein said frame member bears said load sheave at said bearing portion thereof.

32. A hoisting/pulling device according to claim 31, wherein said bearing portion of said load sheave is provided at a center of said frame member.

33. A hoisting/pulling device according to claim 31, wherein said frame member rotatably supports said load sheave and said reduction gears.

34. A hoisting/pulling device according to claim 31, wherein said frame member comprises a first frame and a second frame arranged adjacent to each other.

35. A hoisting/pulling device according to claim 34, wherein a bearing is provided in said first frame, said load sheave is rotatably mounted in said bearing provided in said first frame, and said reduction gears are rotatably mounted in said second frame.

* * * * *